US012404870B2

(12) United States Patent
Nejedly et al.

(10) Patent No.: US 12,404,870 B2
(45) Date of Patent: Sep. 2, 2025

(54) ELECTRICALLY DRIVEN SECONDARY AIR PUMP INCLUDING COMPRESSOR HAVING VANED DIFFUSER RING EMBEDDED IN VOLUTE

(71) Applicant: Garrett Transportation I Inc., Torrance, CA (US)

(72) Inventors: Milan Nejedly, Brno (CZ); Vit Houst, Brno (CZ)

(73) Assignee: Garrett Transportation I Inc., Torrance, CA (US)

( * ) Notice: Subject to any disclaimer, the term of this patent is extended or adjusted under 35 U.S.C. 154(b) by 0 days.

(21) Appl. No.: 18/299,718

(22) Filed: Apr. 13, 2023

(65) Prior Publication Data

US 2024/0344524 A1 Oct. 17, 2024

(51) Int. Cl.

| | |
|---|---|
| ***F04D 29/44*** | (2006.01) |
| ***F04D 17/10*** | (2006.01) |
| ***F04D 25/06*** | (2006.01) |
| ***F04D 27/02*** | (2006.01) |
| ***F04D 29/30*** | (2006.01) |
| *F01D 9/04* | (2006.01) |
| *F04D 29/42* | (2006.01) |

(52) U.S. Cl.

CPC ..... *F04D 29/30* (2013.01); *F04D 17/10* (2013.01); *F04D 25/0606* (2013.01); *F04D 27/0215* (2013.01); *F01D 9/045* (2013.01); *F04D 27/0207* (2013.01); *F04D 29/4213* (2013.01); *F04D 29/441* (2013.01); *F04D 29/444* (2013.01)

(58) Field of Classification Search

CPC ..... F04D 29/441; F04D 29/444; F04D 29/44; F04D 25/0606; F04D 25/06; F04D 27/0207

See application file for complete search history.

(56) References Cited

U.S. PATENT DOCUMENTS 2,372,880 A * 4/1945 Browne ..... F04D 29/444 415/207
4,212,585 A * 7/1980 Swarden ..... F04D 29/685 415/206
4,354,802 A * 10/1982 Nishida ..... F01D 9/045 415/208.4

(Continued)

FOREIGN PATENT DOCUMENTS

EP 1394366 B1 3/2007

*Primary Examiner* — Woody A Lee, Jr.
*Assistant Examiner* — Behnoush Haghighian
(74) *Attorney, Agent, or Firm* — BelayIP

(57) ABSTRACT

An air pump includes a compressor having a compressor wheel mounted in a housing assembly defining an air inlet for leading air flow into the compressor wheel and defining a volute for receiving compressed air from the compressor wheel. A vaned diffuser ring is mounted within the housing assembly radially outward of the compressor wheel and includes an annular vane plate and a plurality of circumferentially spaced vanes having proximal ends rigidly attached to a first side of the plate, the vanes extending axially from the vane plate and distal ends of the vanes being disposed proximate a first wall of the housing assembly axially spaced from the plate such that a vaned diffuser passage is defined between said first wall and the vane plate. The vaned diffuser ring is embedded within the volute such that a second side of the vane plate is wetted by air within the volute.

5 Claims, 8 Drawing Sheets

(56) References Cited

U.S. PATENT DOCUMENTS 4,752,193 A 6/1988 Horler
5,224,842 A * 7/1993 Dziorny ..... F04D 25/04 417/406
5,249,934 A * 10/1993 Merritt ..... F04D 25/04 417/406
6,065,297 A * 5/2000 Tischer ..... F25B 31/008 62/505
6,176,092 B1 * 1/2001 Butterworth ..... F25B 31/002 62/505
8,070,416 B2 * 12/2011 Gottemoller ..... F04D 27/0253 415/206
8,235,648 B2 * 8/2012 LeBlanc ..... F02C 3/08 415/58.4
8,240,984 B2 * 8/2012 Noelle ..... F04D 29/462 415/206
8,272,832 B2 * 9/2012 Yin ..... F04D 29/685 415/206
8,328,535 B2 * 12/2012 Anschel ..... F01D 17/165 415/208.4
8,511,083 B2 * 8/2013 Arnold ..... F04D 29/682 60/602
8,556,573 B2 * 10/2013 LeBlanc ..... F04D 29/681 415/58.4
8,784,053 B2 * 7/2014 Colson ..... F04D 29/541 415/206
8,807,921 B2 * 8/2014 Struziak ..... F04D 29/063 415/113
8,851,835 B2 * 10/2014 Merritt ..... F04D 29/4213 415/211.2
8,939,718 B2 * 1/2015 Claus ..... F04D 29/444 415/206
9,091,200 B2 7/2015 Lombard et al.
9,255,586 B2 * 2/2016 Lee ..... F04D 29/444
9,387,298 B2 * 7/2016 Bothma ..... F04D 29/441
9,393,652 B2 * 7/2016 Colson ..... F01D 25/243
9,470,140 B2 * 10/2016 An ..... F16C 39/02
9,719,518 B2 * 8/2017 Mohtar ..... F04D 27/0207
9,863,439 B2 * 1/2018 Rosen ..... F04D 29/681
9,873,515 B2 * 1/2018 Beers ..... F04D 17/025
9,976,568 B2 * 5/2018 Merritt ..... F04D 29/444
10,316,859 B2 * 6/2019 Harris ..... F04D 29/667
10,400,789 B2 * 9/2019 Harley ..... F04D 29/284
10,823,197 B2 * 11/2020 Duong ..... F04D 29/444
2006/0059942 A1 * 3/2006 McAuliffe ..... F25B 9/004 62/402
2006/0062665 A1 * 3/2006 McAuliffe ..... F04D 29/462 415/191
2007/0137201 A1 * 6/2007 Arnold ..... F04D 29/684 60/605.1
2007/0196206 A1 8/2007 Martin et al.
2009/0263234 A1 * 10/2009 Yin ..... F04D 29/685 415/58.4
2010/0077768 A1 * 4/2010 LeBlanc ..... F04D 29/681 60/785
2010/0260595 A1 * 10/2010 Gottemoller ..... F04D 27/0253 415/146
2011/0189011 A1 * 8/2011 Claus ..... F04D 29/444 415/213.1
2012/0156009 A1 * 6/2012 Colson ..... F04D 19/002 29/889.21
2012/0156027 A1 * 6/2012 Merritt ..... F04D 29/4213 415/207
2012/0186247 A1 * 7/2012 Marques ..... F02C 6/12 60/605.1
2012/0275916 A1 * 11/2012 LeBlanc ..... F02C 3/08 415/207
2013/0115052 A1 * 5/2013 Lee ..... F04D 29/664 415/207
2014/0090626 A1 * 4/2014 An ..... F16C 39/02 29/598
2015/0023787 A1 * 1/2015 Merritt ..... F04D 29/4213 415/207
2015/0226232 A1 * 8/2015 Duong ..... F04D 29/684 415/203
2016/0076554 A1 * 3/2016 Rosen ..... F04D 29/681 415/207
2018/0172022 A1 * 6/2018 Duong ..... F04D 29/684
2023/0137972 A1 * 5/2023 Drake ..... F04D 17/10 62/505

* cited by examiner

ELECTRICALLY DRIVEN SECONDARY AIR PUMP INCLUDING COMPRESSOR HAVING VANED DIFFUSER RING EMBEDDED IN VOLUTE

BACKGROUND OF THE INVENTION

The present disclosure relates to secondary air pumps for use in vehicle internal combustion engine systems.

Internal combustion engine systems are increasingly being held to stricter and stricture regulations on emissions from the system. Various strategies, generally employing one or more catalytic devices for treating exhaust gases, are in common use for reducing the levels of undesirable emissions. The use of secondary air injection (SAI) using a secondary air pump (SAP) is a known technique for assisting in the reduction of engine emissions. The SAP is employed for injecting fresh air into the exhaust stream from the engine during certain operating conditions to assist in burning or oxidation of pollutants (for example, unburned hydrocarbons) in the exhaust gases.

After a cold start of the engine, the amount of unburned hydrocarbons in the exhaust gases tends to be increased, and levels of undesirable emissions out the tailpipe are relatively high until the catalytic treatment device reaches its light-off temperature. By injecting fresh air into the exhaust gases ahead of the catalytic treatment device, pollutants such as unburned hydrocarbons can be oxidized through an exothermic chemical reaction that helps heat up the catalyst more quickly. Indeed, in some cases, fuel can be intentionally injected into the exhaust gas stream ahead of the catalyst, together with secondary air injection, to induce this exothermic reaction to more-quickly heat up the catalyst.

Secondary air pumps typically comprise centrifugal compressors. A challenge for secondary air pumps is that engine system designers are increasingly demanding higher pressures from them, but at very low flow rates. This is an operating regime that places the compressor near its surge line, and flow instabilities can occur. While techniques for delaying surge to lower flow rates are generally known for centrifugal compressors, these techniques tend to be ineffective at the very low flow rates that a SAP must operate at.

BRIEF SUMMARY OF THE DISCLOSURE

The present disclosure is directed to a secondary air pump for use in internal combustion engine systems, comprising:

a centrifugal compressor comprising a housing assembly and a compressor wheel mounted in the housing assembly and connected to a rotatable shaft for rotation therewith about a rotational axis, the housing assembly defining an air inlet for leading air along an axial direction into the compressor wheel and defining a volute for receiving compressed air discharged radially outwardly from the compressor wheel; and a vaned diffuser ring fixedly mounted within the housing assembly radially outward of the compressor wheel and comprising an annular vane plate having a first side and an opposite second side and a plurality of circumferentially spaced vanes having proximal ends rigidly attached to the first side, the vanes extending axially from the vane plate and distal ends of the vanes being disposed proximate a first wall of the housing assembly axially spaced from the vane plate such that a vaned diffuser passage is defined between said first wall and the vane plate;

wherein the vaned diffuser ring is embedded within the volute such that the second side of the vane plate is wetted by air within the volute.

In one embodiment, a radial gap extends between a radially outer periphery of the compressor wheel and leading edges of the vanes, and said radial gap is axially bounded between said first wall of the housing assembly and an opposite second wall of the housing assembly. The leading edges of the vanes extend radially inwardly of a radially inner periphery of the vane plate in one embodiment.

Optionally, the vaned diffuser ring can be press-fit to secure it within the housing assembly. In this case, the housing assembly defines a cylindrical surface and there is an interference fit between the radially inner periphery of the vane plate and said cylindrical surface to secure the vaned diffuser ring in place.

The volute can follow the vaned diffuser ring with respect to said axial direction along which the air flow enters the compressor wheel. Alternatively, the volute can precede the vaned diffuser ring with respect to said axial direction.

In come cases, the inclusion of the vaned diffuser ring can negatively affect flow stability. Therefore, in some embodiments, the pump can further comprise a recirculation channel defined in the housing assembly, the recirculation channel having one end connected downstream of an inducer portion of the compressor wheel and an opposite end connected to the air inlet to allow a fraction of the compressed air to be bled off and recirculated back to the air inlet as a surge suppression technique.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE DRAWINGS

The present inventions now will be described more fully hereinafter with reference to the accompanying drawings, in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
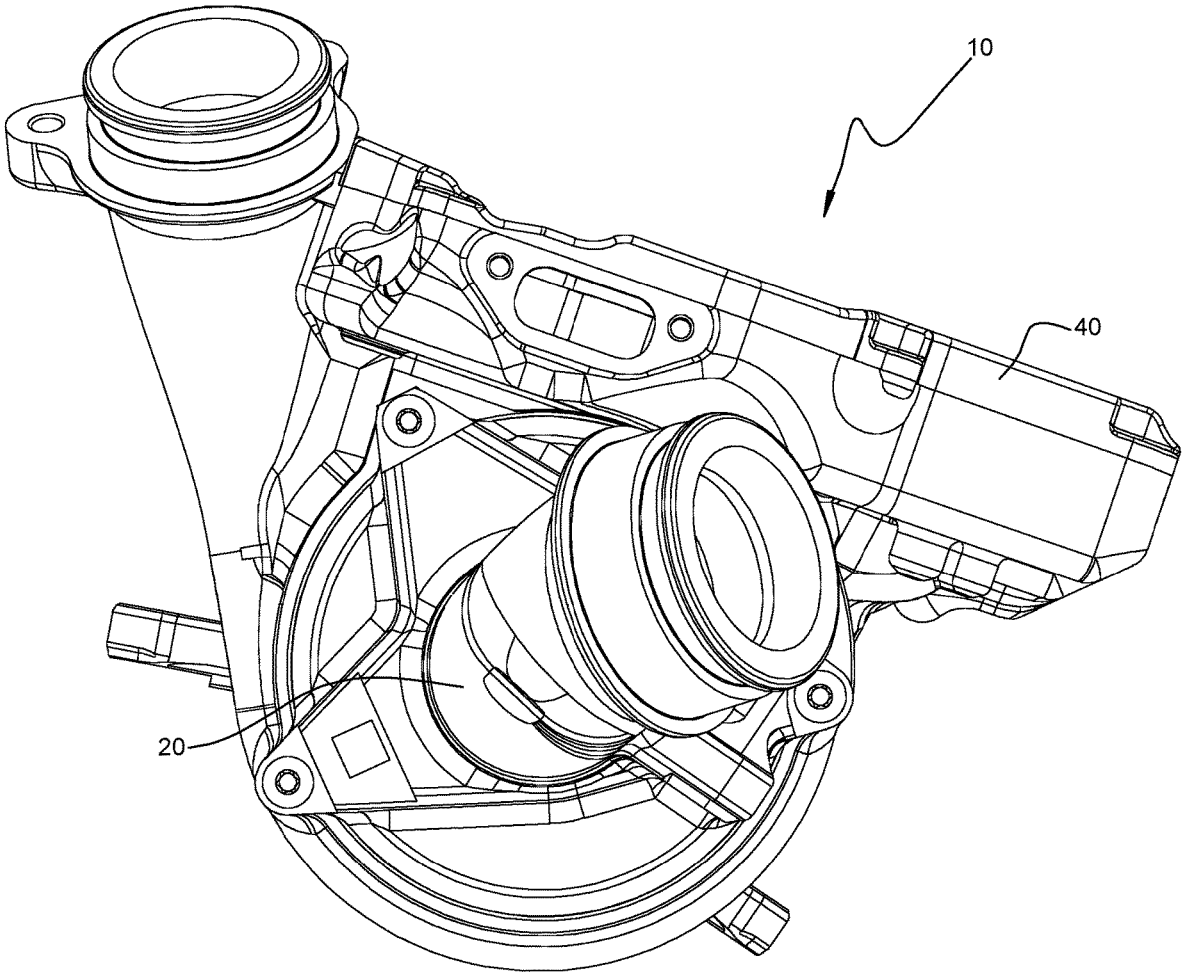
FIG. 1 is an axial end view of an electric air pump in accordance with one embodiment of the invention.
Figure 2:
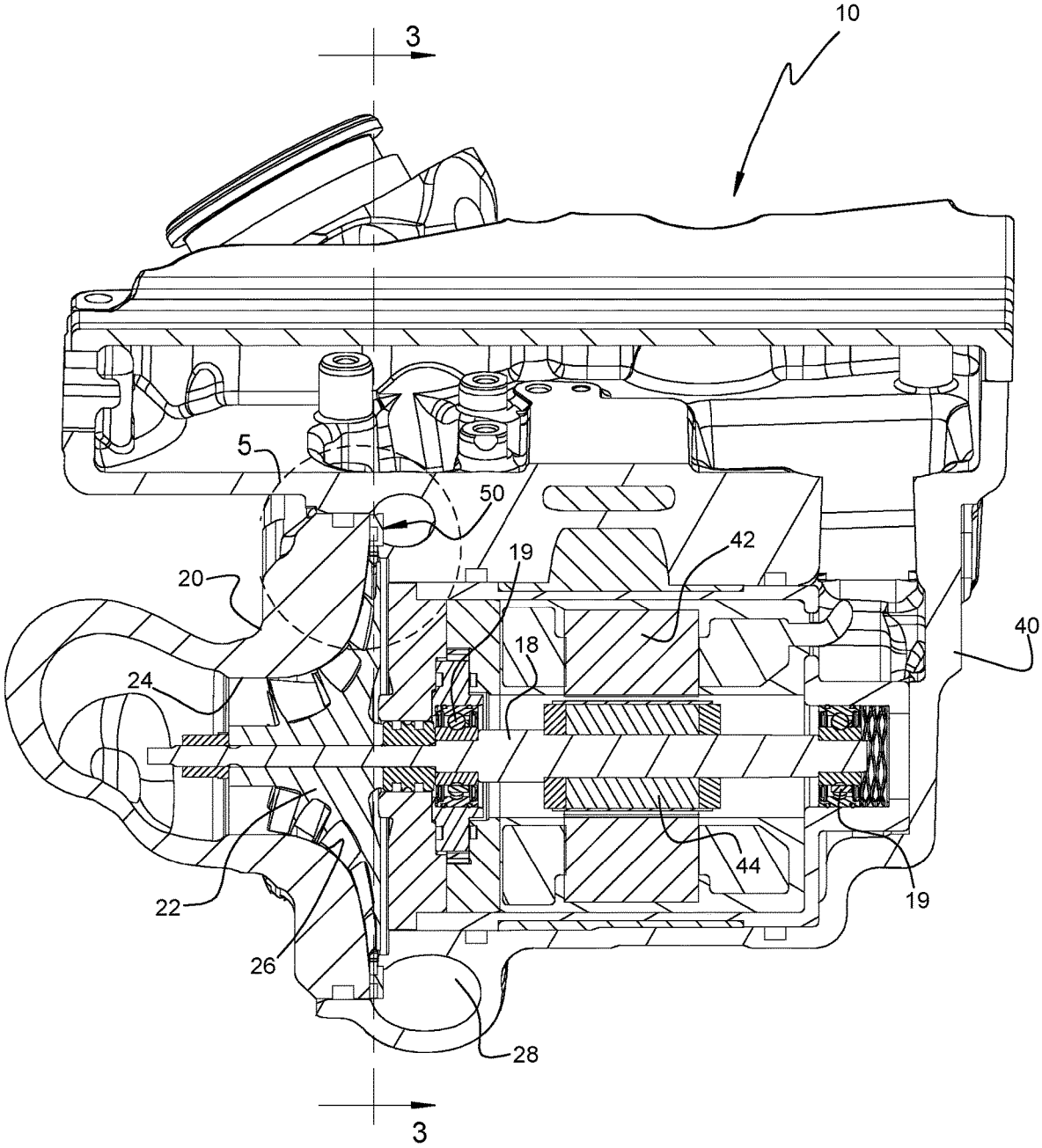
FIG. 2 is an axial cross-sectional view of the pump along line 2-2 in FIG. 3.
Figure 3:
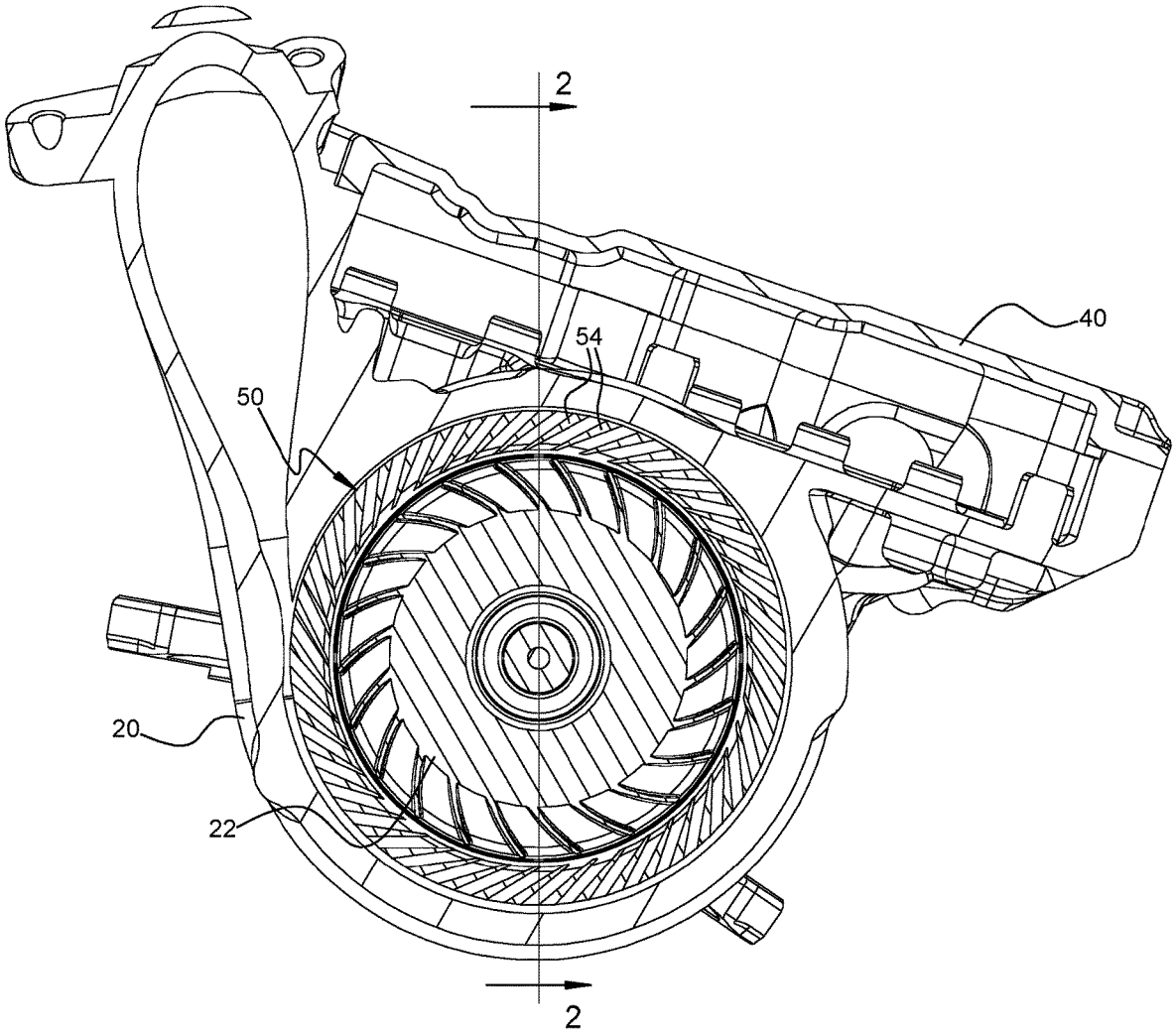
FIG. 3 is a cross-sectional view along line 3-3 in FIG. 2.

A secondary air pump (SAP) 10 in accordance with one embodiment of the invention is illustrated in FIGS. 1-3. With primary reference to FIG. 2, the pump includes a housing assembly comprising a compressor housing 20 and a motor housing 40. The compressor housing contains a compressor wheel 22 affixed to a rotational shaft 18. The compressor housing defines an air inlet 24 that leads air axially into the compressor wheel, and defines a shroud wall 26 that lies closely adjacent to tips of the blades of the compressor wheel with a small clearance therebetween.

The motor housing 40 contains a motor stator 42 and a motor rotor 44. The motor rotor is affixed to the shaft 18 for rotation therewith, and the motor stator surrounds the motor rotor. The shaft 18 is rotationally supported in bearings 19 contained within the motor housing. The motor housing also defines a volute 28 that receives and collects the air compressed by the compressor wheel, for onward delivery to a component of an internal combustion engine system (not shown). In alternative embodiments such as that of FIG. 6, the volute can be defined by the compressor housing rather than the motor housing. Operation of the electric motor rotationally drives the compressor wheel 22 to compress the air for use within the internal combustion engine system.

Secondary air pumps must be able to operate at very low flow rates. At such flow rates, techniques that are typically employed with centrifugal compressors to shift the surge line of the compressor to lower flow rates (e.g., inlet adjustment mechanisms, A/R, inlet and outlet blade angles, etc.) no longer work effectively. In accordance with the present invention, stable pump operation is attainable at very low flow rates by virtue of the provision of a vaned diffuser ring 50 that is embedded within the volute 28.

Figure 4A:
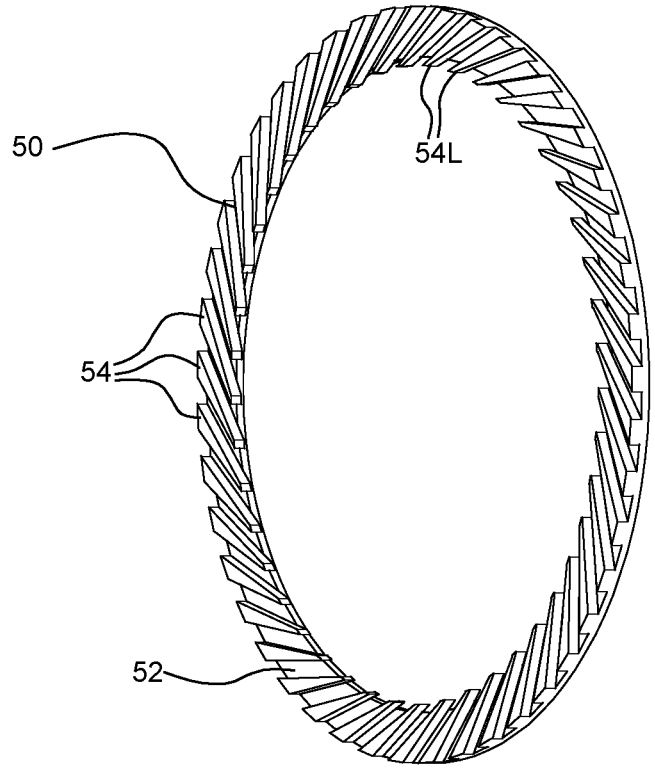
FIG. 4A is an isometric view of a vaned diffuser ring in accordance with one embodiment of the invention.
Figure 4B:
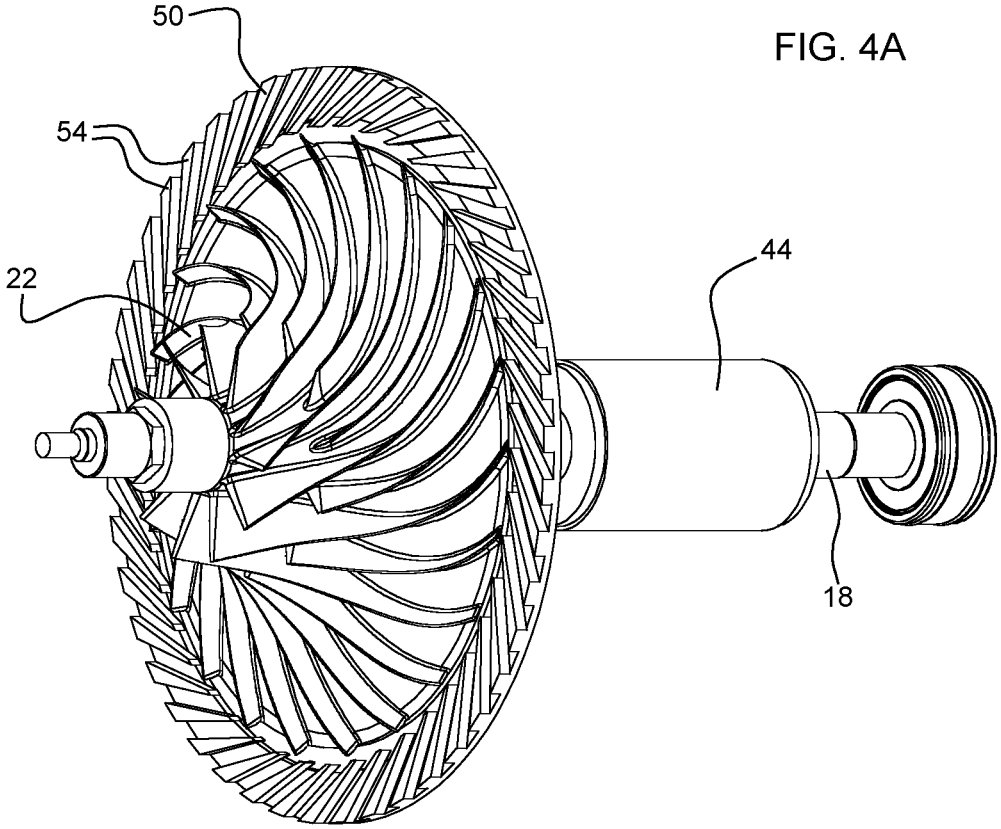
FIG. 4B is an isometric view of a sub-assembly consisting of the vaned diffuser ring and a rotating assembly (compressor wheel, shaft, motor rotor) in accordance with one embodiment of the invention.
Figure 5:
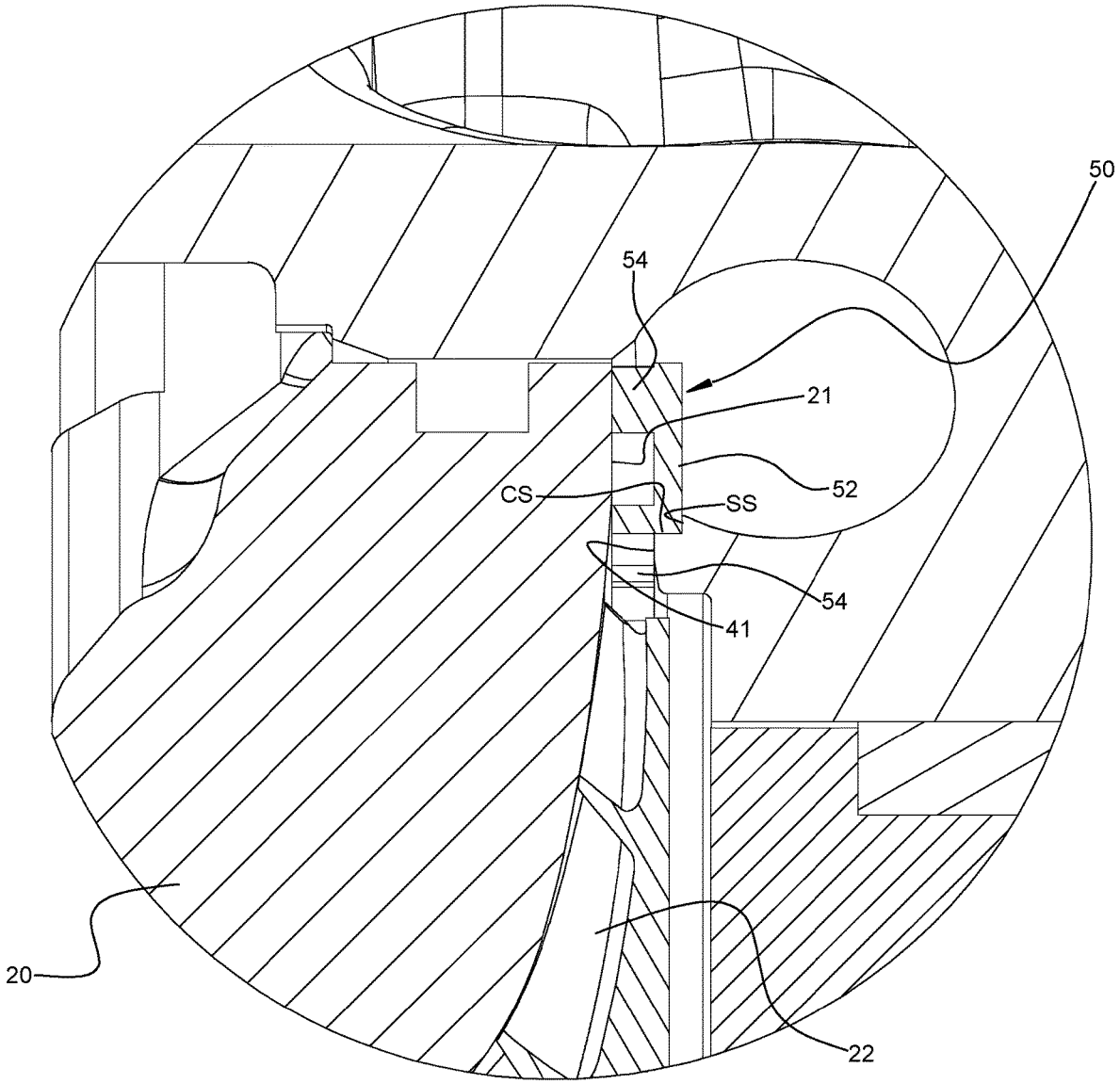
FIG. 5 is a magnified portion of FIG. 2, detailing the vaned diffuser ring embedded within the volute in accordance with one embodiment of the invention.

With reference to FIGS. 2-4B, the vaned diffuser ring 50 comprises an annular vane plate 52 having opposite first and second sides. A plurality of circumferentially spaced vanes 54 are affixed to the first side of the vane plate. The inside diameter of the vane plate exceeds the maximum diameter of the compressor wheel 22 by a predetermined amount. As best seen in FIG. 4A, the leading edges 54L of the vanes extend radially inwardly beyond the inner periphery of the vane plate, but are radially spaced outward of the maximum diameter of the compressor wheel as best seen in FIG. 4B. A radial gap extends between a radially outer periphery of the compressor wheel and the leading edges of the vanes, and said radial gap is axially bounded between a first wall 21 of the housing assembly and an opposite second wall 41 of the housing assembly (FIG. 5).

In conventional centrifugal compressors having diffuser vanes, the vanes and the volute are serially arranged with respect to the radial direction, such that the air first passes through the vanes and then exits from the vanes and enters the volute. In contrast, in accordance with the invention, the vaned diffuser ring 50 is embedded within the volute 28 and hence the air passing through the vanes has already entered the volute prior to exiting from the vane array. FIG. 5 illustrates the embedding of the vaned diffuser ring 50 within the volute 28, which results in the second side of the vane plate 52 (i.e., the side opposite from that having the vanes 54) being wetted by the air within the volute. The air passing through the vanes is constrained to flow between the first side of the vane plate 52 and the opposite first wall 21 of the housing assembly.

The vaned diffuser ring 50 can be secured within the housing assembly in any suitable manner. In one embodiment, with reference to FIG. 5, the ring 50 is press-fit into the motor housing 40. In this regard, the motor housing 40 defines a cylindrical surface CS whose diameter is slightly larger than the inside diameter of the vane plate 52. The diffuser ring is press-fit onto the cylindrical surface until the plate abuts a hard stop surface SS defined by the housing 40.

The presence of the vanes in the diffuser significantly alters the aerodynamics of the air flow through the compressor wheel. The compressor wheel used in a secondary air pump is quite small, and the height of the compressor blades at the exduder of the wheel can be approximately 1 millimeter (a significant portion of which is occupied by the necessary blade fillets). The required clearance between the blade tips and the housing shroud surface can be 30 to 50 percent of the exducer blade height, which leads to significant aerodynamic losses. When the vanes are inserted into the diffuser, the air flow inside the wheel is changed so that the effect of flow through the clearance is reduced. Accordingly, the peak efficiency line on the compressor map is shifted to lower flow rates, and a slight increase in pressure ratio can be achieved in the region between the peak-efficiency line and the surge line.

Figure 6:
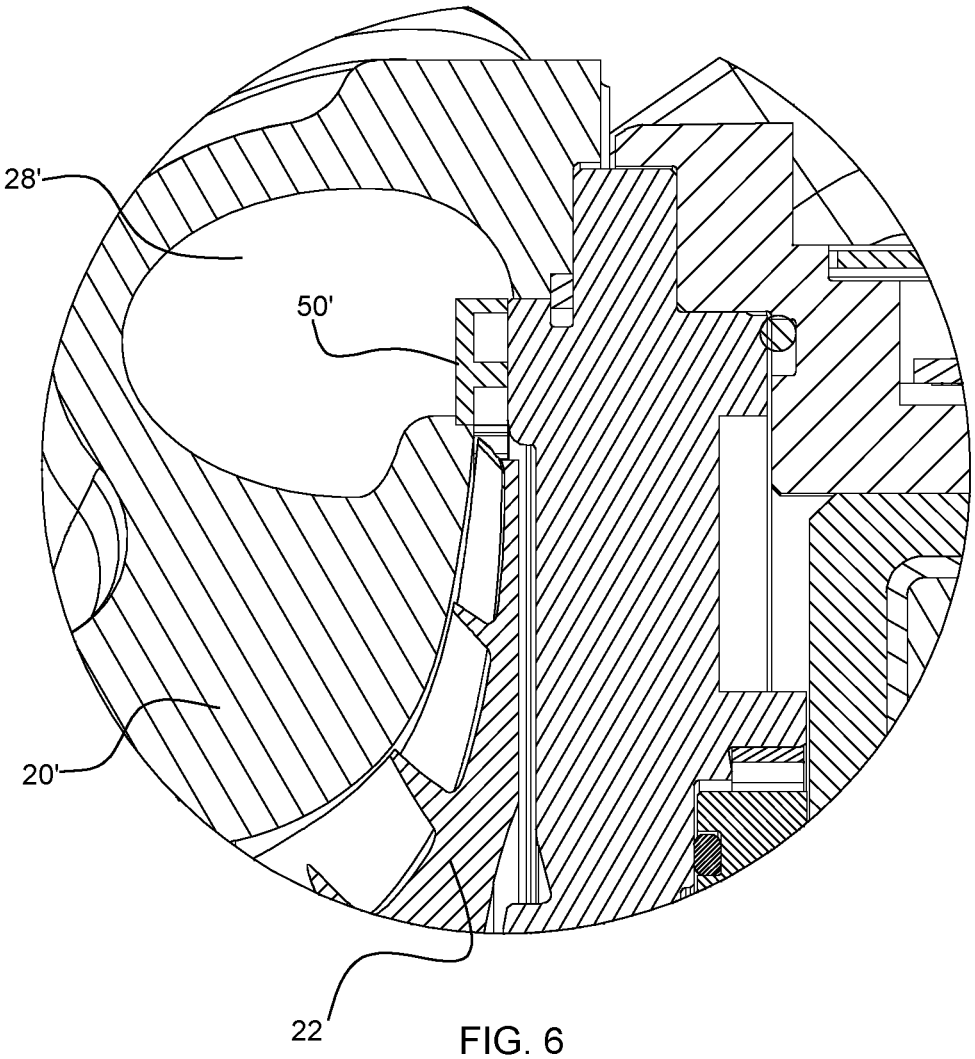
FIG. 6 is a view similar to FIG. 5, showing an alternative embodiment of the invention.

The embodiment of FIGS. 1-5 has the volute 28 located on the motor side of the pump; that is, with respect to the axial direction along which air enters through the air inlet and approaches the compressor wheel, the volute follows the vaned diffuser ring, as best seen in FIG. 5, where said axial direction is left to right. Alternatively, as shown in the embodiment of FIG. 6, the volute 28' can precede the vaned diffuser ring 50' with respect to said axial direction; that is, the volute is located on the compressor side of the pump. In that case, the volute 28' can be defined within the compressor housing 20'.

Figure 7:
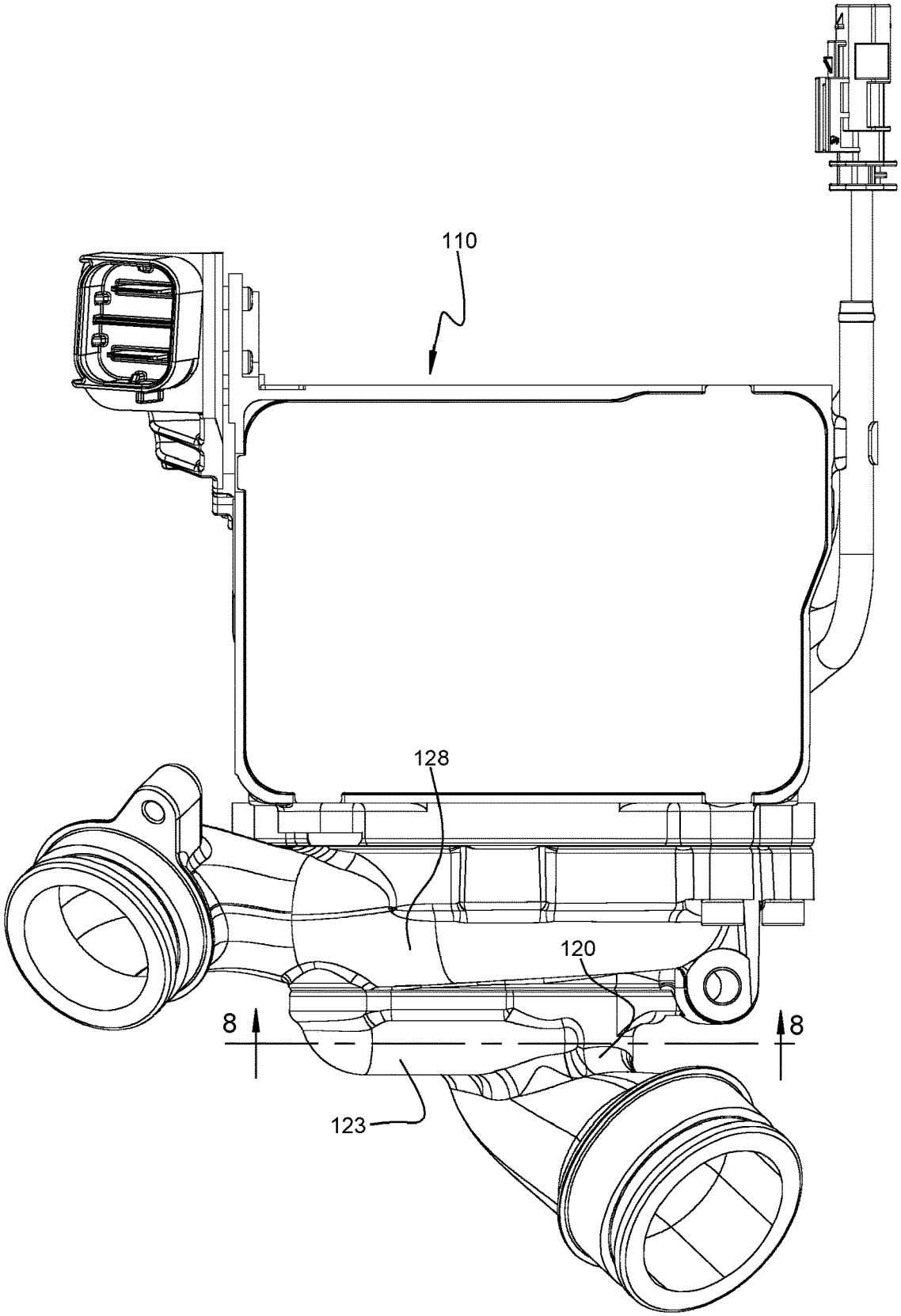
FIG. 7 is a side view of an electric air pump in accordance with a further embodiment of the invention.
Figure 8:
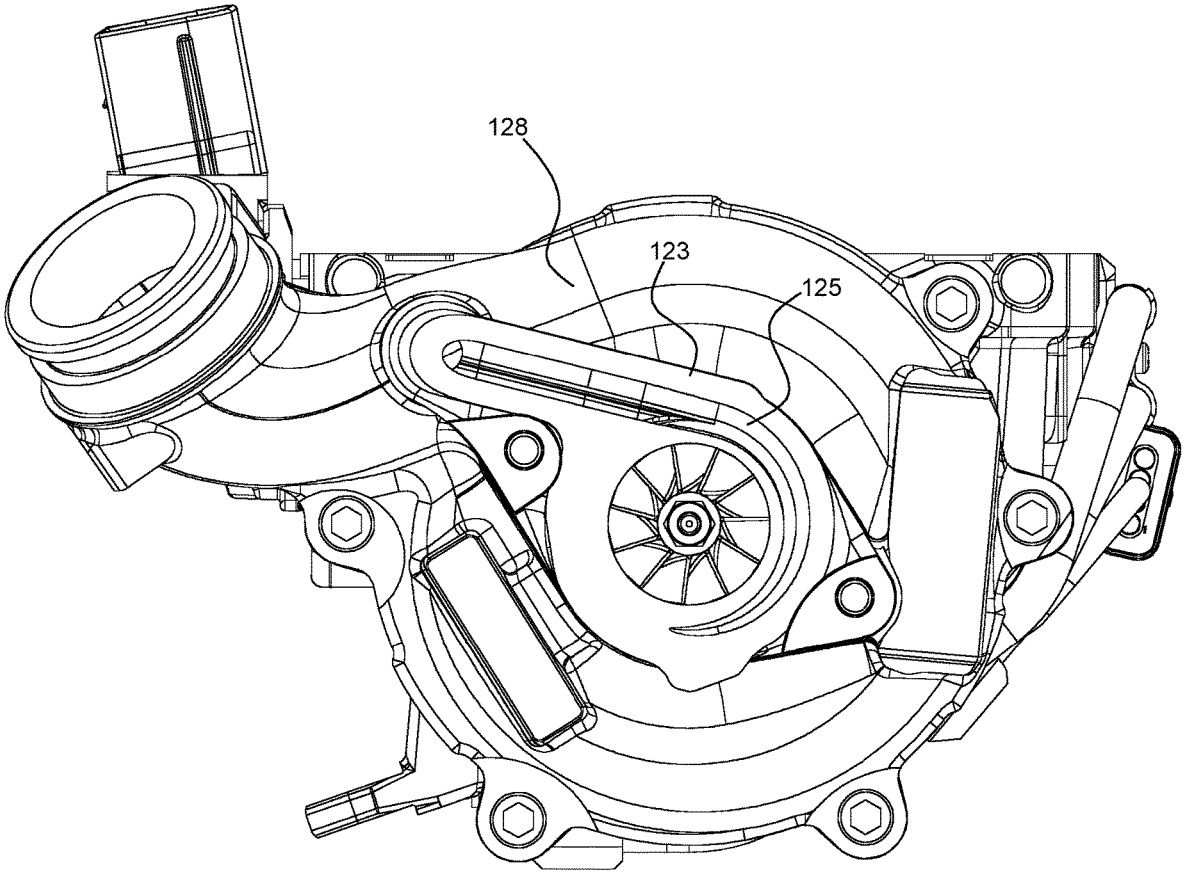
FIG. 8 is an axial end view of the pump of FIG. 7, sectioned along line 8-8.

In some cases, there may be a desire to enhance flow stability through the compressor wheel, given that the pump operation typically will be at very low flow rates and relatively high pressure ratio, and hence in a region of the compressor map where the flow can potentially become unstable. In such cases, flow recirculation can be employed to enhance stability. As an example, FIGS. 7 and 8 depict an embodiment of a secondary air pump 110 having a pipe 123 connected at one end to the volute 128 and at the opposite end to the air inlet of the compressor housing 120. The pipe 123 defines a recirculation passage 125 for leading a fraction of the compressed air back to the air inlet, which is a known technique for reducing the likelihood of surge of the compressor.

A vaned diffuser in accordance with the invention can shift the peak efficiency line of the compressor to lower flow rates without significant loss in the compressor wheel. This leads to more optimal aerodynamic parameters, which will slightly increase pressure ratio in the area from the surge-line to the peak efficiency line. On the other hand, the compressor capacity and the aerodynamic parameter will be significantly reduced from the peak efficiency line to the choke line. However, this may not matter for certain SAP applications such as those without a boost function. The surge line can also be negatively affected with respect to flow stability. However, in synergy with the recirculation channel, its constant position can be assumed relative to a vaneless diffuser compressor with low trim (smaller than T16) compressor wheel.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An automotive secondary air pump for providing secondary air injection to an internal combustion engine of an automobile, comprising:

a centrifugal compressor comprising a housing assembly and a compressor wheel mounted in the housing assembly and connected to a rotatable shaft for rotation therewith about a rotational axis, the housing assembly defining an air inlet for leading air flow along an axial direction into the compressor wheel and defining a volute for receiving compressed air discharged radially outwardly from the compressor wheel and for discharging secondary air to the internal combustion engine of the automobile;

an electric motor within the housing assembly and comprising a motor stator and a motor rotor, the motor rotor being mounted on the shaft for rotation therewith; and a vaned diffuser ring formed separately from the housing assembly fixedly mounted within the housing assembly radially outward of the compressor wheel and embedded within the volute, the vaned diffuser ring comprising an annular vane plate having a first side and an opposite second side and a plurality of circumferentially spaced vanes having proximal ends rigidly attached to the first side, the vanes extending axially from the vane plate and distal ends of the vanes being disposed proximate a first wall of the housing assembly axially spaced from the vane plate such that a vaned diffuser passage is defined between said first wall and the vane plate;

wherein the volute follows the vaned diffuser ring with respect to said axial direction and the vaned diffuser ring is embedded within the volute such that the second side of the vane plate is wetted by air within the volute.

2. The automotive secondary air pump of claim 1, wherein a radial gap extends between a radially outer periphery of the compressor wheel and leading edges of the vanes, and said radial gap is axially bounded between said first wall of the housing assembly and an opposite second wall of the housing assembly.

3. The automotive secondary air pump of claim 2, wherein the leading edges of the vanes extend radially inwardly of a radially inner periphery of the vane plate.

4. The automotive secondary air pump of claim 3, wherein the housing assembly defines a cylindrical surface and the radially inner periphery of the vane plate is press-fit onto said cylindrical surface to secure the vaned diffuser ring in place.

5. The automotive secondary air pump of claim 1, further comprising a recirculation channel defined in the housing assembly, the recirculation channel having one end connected downstream of an inducer portion of the compressor wheel and an opposite end connected to the air inlet such that a fraction of the air flow through the compressor wheel is bled off and recirculated back to the air inlet for surge suppression.

* * * * *